US005946989A

United States Patent [19]

Hsieh

[11] Patent Number: 5,946,989

[45] Date of Patent: Sep. 7, 1999

[54] BOX END FOR A BOX END WRENCH

[76] Inventor: Chih-Ching Hsieh, No. 64, Lane 107, Liang Tsun Rd., Fong Yuan, Taichung Hsien, Taiwan

[21] Appl. No.: 09/094,816

[22] Filed: Jun. 15, 1998

[51] Int. Cl.[6] ..... B25B 13/00

[52] U.S. Cl. ..... 81/124.3; 81/119; 81/180.1

[58] Field of Search ..... 81/119, 121.1, 81/124.3, 125, 180.1, 186

[56] References Cited

U.S. PATENT DOCUMENTS

| | | | |
|---|---|---|---|
| 2,727,418 | 12/1955 | Moon | 81/124.3 |
| 2,751,802 | 6/1956 | Ruillard | 81/124.3 |
| 2,769,360 | 11/1956 | Cottrell et al. | 81/124.3 |
| 2,774,259 | 12/1956 | Caulkins | 81/124.3 X |
| 4,787,278 | 11/1988 | Bononi | 81/125 X |
| 5,307,713 | 5/1994 | White | 81/125 X |

*Primary Examiner*—James G. Smith
*Attorney, Agent, or Firm*—Varndell Legal Group

[57] ABSTRACT

A box end of a box end wrench having a substantially Ω-shaped constraint spring rod mounted therein for stopping the workpiece in the box end, enabling the workpiece to be positively turned with the box end wrench, the constraint spring rod having two opposite ends respectively inserted into two opposite radial through holes on the peripheral wall of the box end, and an arched middle section closely attached to the inside wall of the box end for stopping the workpiece in the box end.

1 Claim, 9 Drawing Sheets

BOX END FOR A BOX END WRENCH

BACKGROUND AND SUMMARY OF THE INVENTION

The present invention relates to a wrench, and more specifically to a box end for a box end wrench which has a substantially Ω-shaped constraint spring rod mounted in the box end for stopping the workpiece in the box end, enabling the workpiece to be positively turned with the box end wrench.

A variety of box end wrenches have been disclosed, and have appeared on the market. FIGS. 1 and 2 show a regular box end wrench. This structure of box end wrench has a handle, and a box end at one end of the handle. The box end defines a box for attaching to the hexagon head bolt or hexagon nut to be turned. When the box end wrench is attached to for example a hexagon head bolt, the box end may slip from the hexagon head of the hexagon head bolt when box end wrench is turned with the hand. FIGS. 3 and 5 show another structure of box end wrench according to the prior art which comprises a steel ball mounted in a hole on a flange at one side of the handle and suspending above the box at the border area. When the box end of the box end wrench is attached to the hexagon head bolt to be turned, the steel ball is stopped at the top of the hexagon head of the hexagon head bolt, enabling the hexagon head bolt to be positively turned with the box end wrench. This structure of box end wrench is not durable in use because the steel ball wears quickly with use. Further, the steel ball can not positively stop the wokpiece in place and an excessive downward pressure is given to the box end. FIGS. 4 and 6 show still another structure of box end wrench according to the prior art which uses a sliding bar for securing the box end to the workpiece. This structure of box end wrench is inconvenient in use because the sliding stop bar must be frequently moved in and out along the handle. Further, the application range of the box end wrench is limited. FIGS. 7 and 8 show still another structure of box end wrench in which an inward annular flange is provided at one side of the box in each box end. Because the inward annular flange is integral with the inside wall of the box end, it is difficult to process teeth on the inside wall of the box end.

It is one object of the present invention to provide a box end for a box end wrench which firmly secures the workpiece in place, enabling the workpiece to be positively turned with the box end wrench. It is another object of the present invention to provide a box end for a box end wrench which is easy to manufacture. It is still another object of the present invention to provide a box end for a box end wrench which is practical for a mass production to reduce the manufacturing cost. According to the present invention, a substantially Ω-shaped constraint spring rod is mounted inside the box end of the box end wrench for stopping the workpiece in the box end, enabling the workpiece to be positively turned with the box end wrench. The constraint spring rod has two opposite ends respectively inserted into two opposite radial through holes on the peripheral wall of the box end, and an arched middle section closely attached to the inside wall of the box end for stopping the workpiece in the box end.

DETAILED DESCRIPTION OF THE PREFERRED EMBODIMENT

Figure 1:
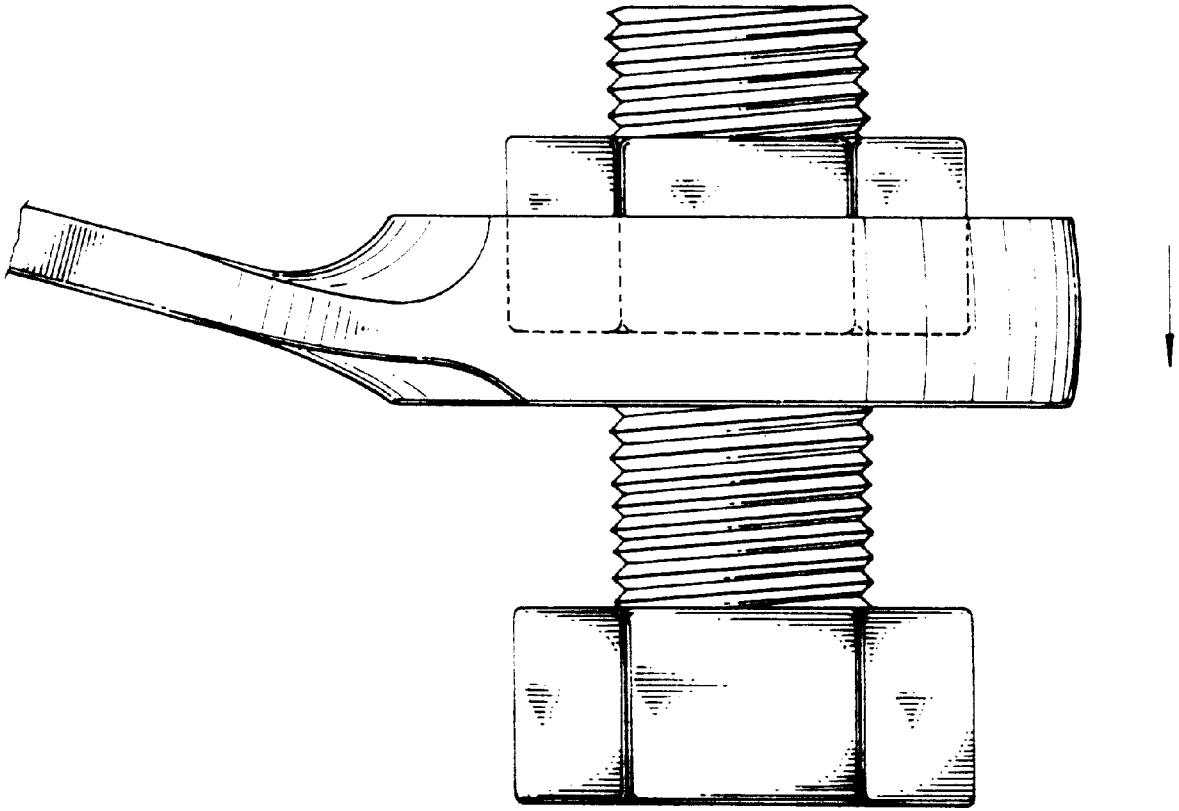
Fig. 1 PRIOR ART
FIG. 1 is a schematic drawing showing the box end of a box end wrench slipped on the workpiece according to the prior art.
Figure 2:
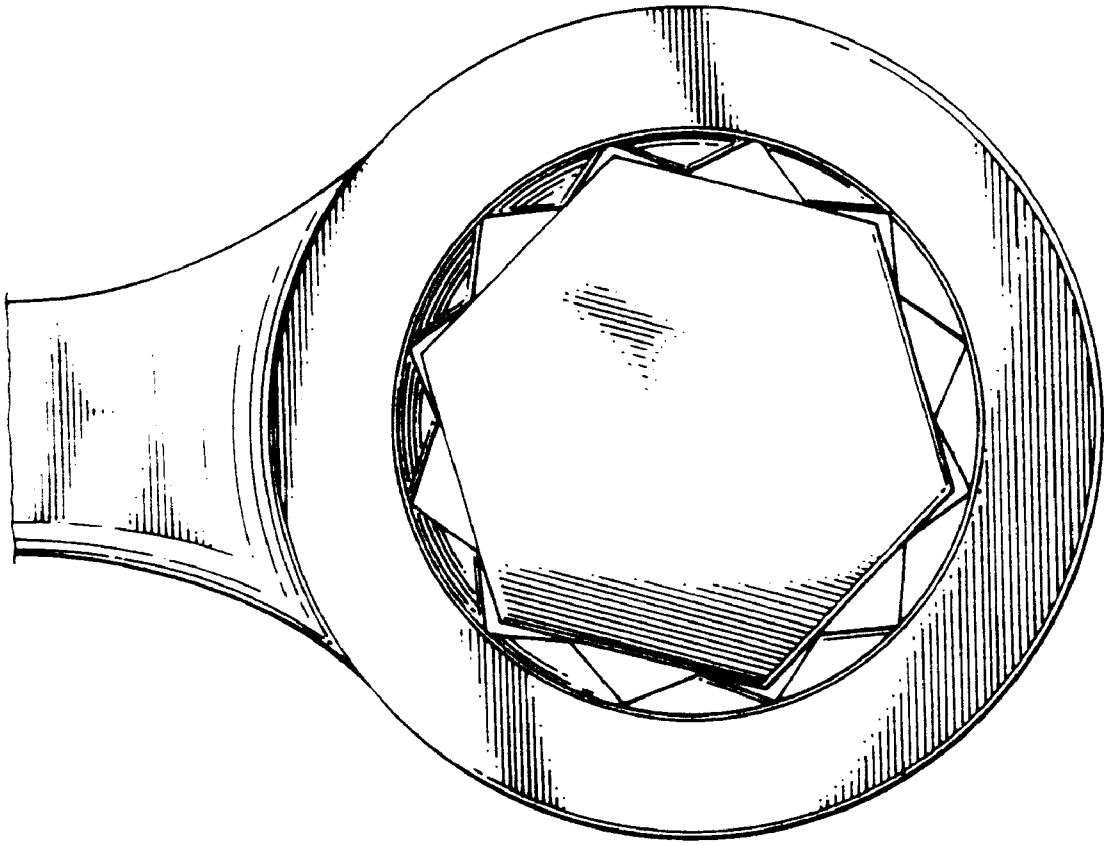
Fig. 2 PRIOR ART
FIG. 2 is a top view of the box end of the box end wrench shown in FIG. 1.
Figure 3:
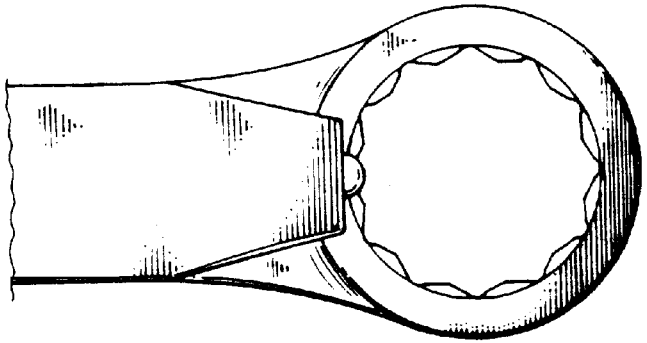
Fig. 3 PRIOR ART
FIG. 3 is a top view of another structure of box end wrench according to the prior art.
Figure 4:
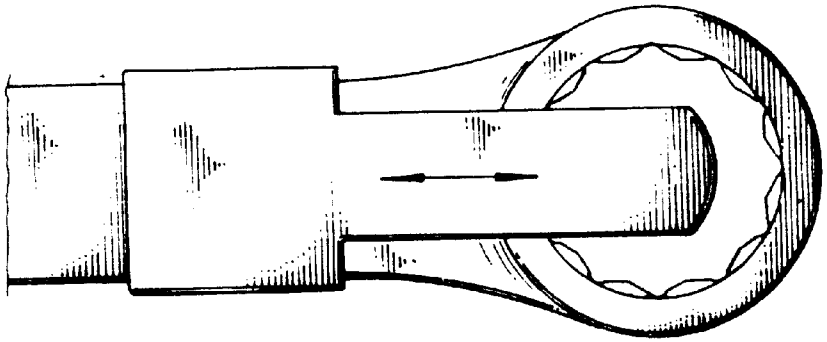
Fig. 4 PRIOR ART
FIG. 4 is a top view of still another structure of box end wrench according to the prior art.
Figure 5:
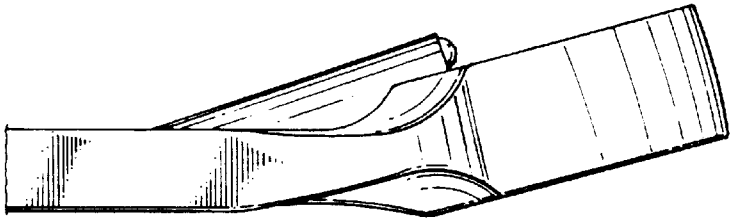
Fig. 5 PRIOR ART
FIG. 5 is a side view of FIG. 3.
Figure 6:
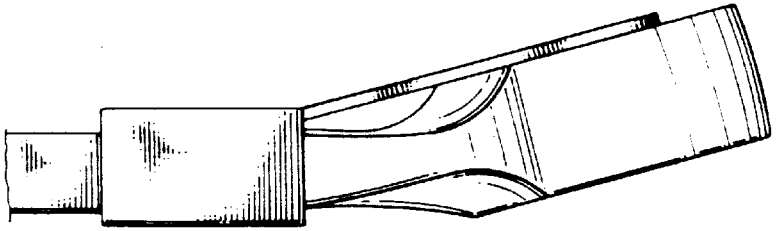
Fig. 6 PRIOR ART
FIG. 6 is a side view of FIG. 4.
Figure 7:
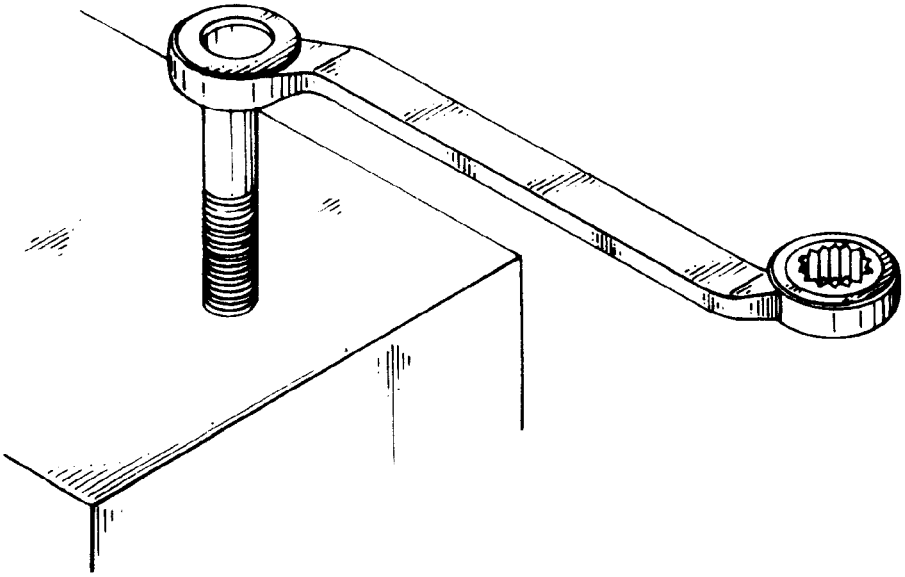
Fig. 7 PRIOR ART
FIG. 7 shows still another structure of box end wrench according to the prior art.
Figure 8:
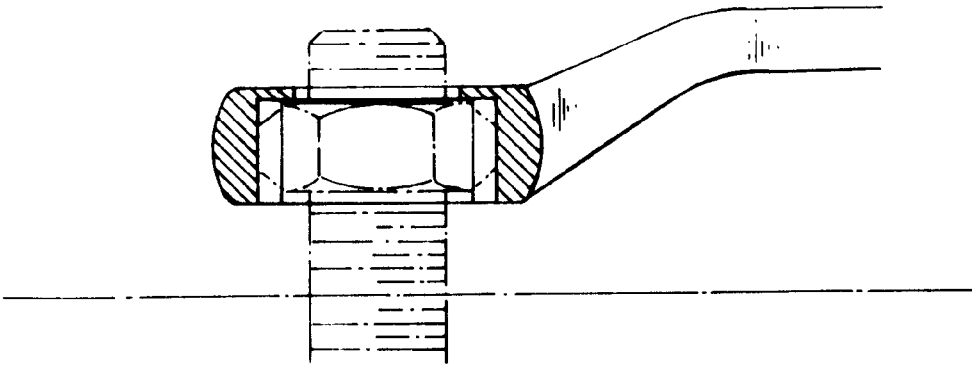
Fig. 8 PRIOR ART
FIG. 8 is a side view in section of a part of the box end wrench shown in FIG. 7, showing the inward annular flange stopped above a hexagon but on a screw rod.
Figure 9:
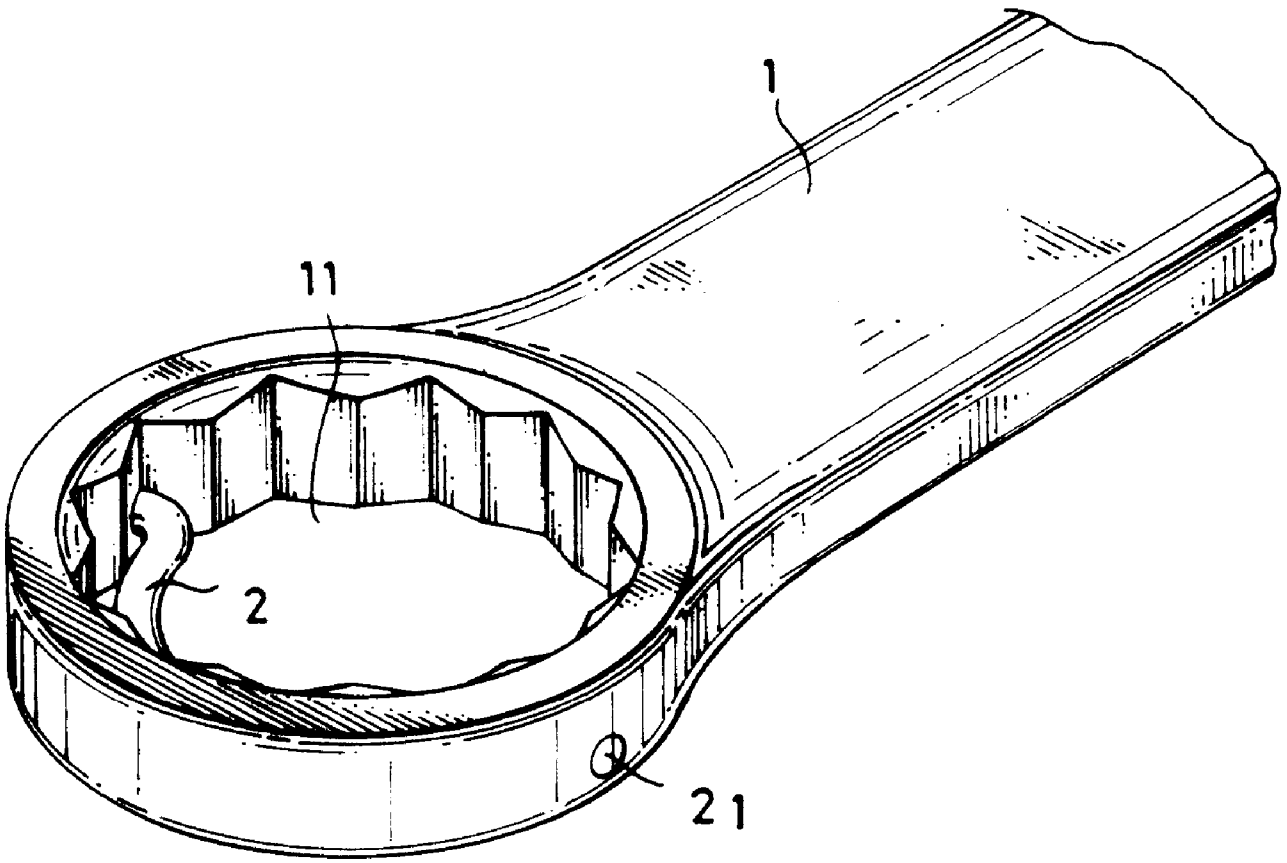
FIG. 9 is a perspective view of a box end wrench according to the present invention.
Figure 10:
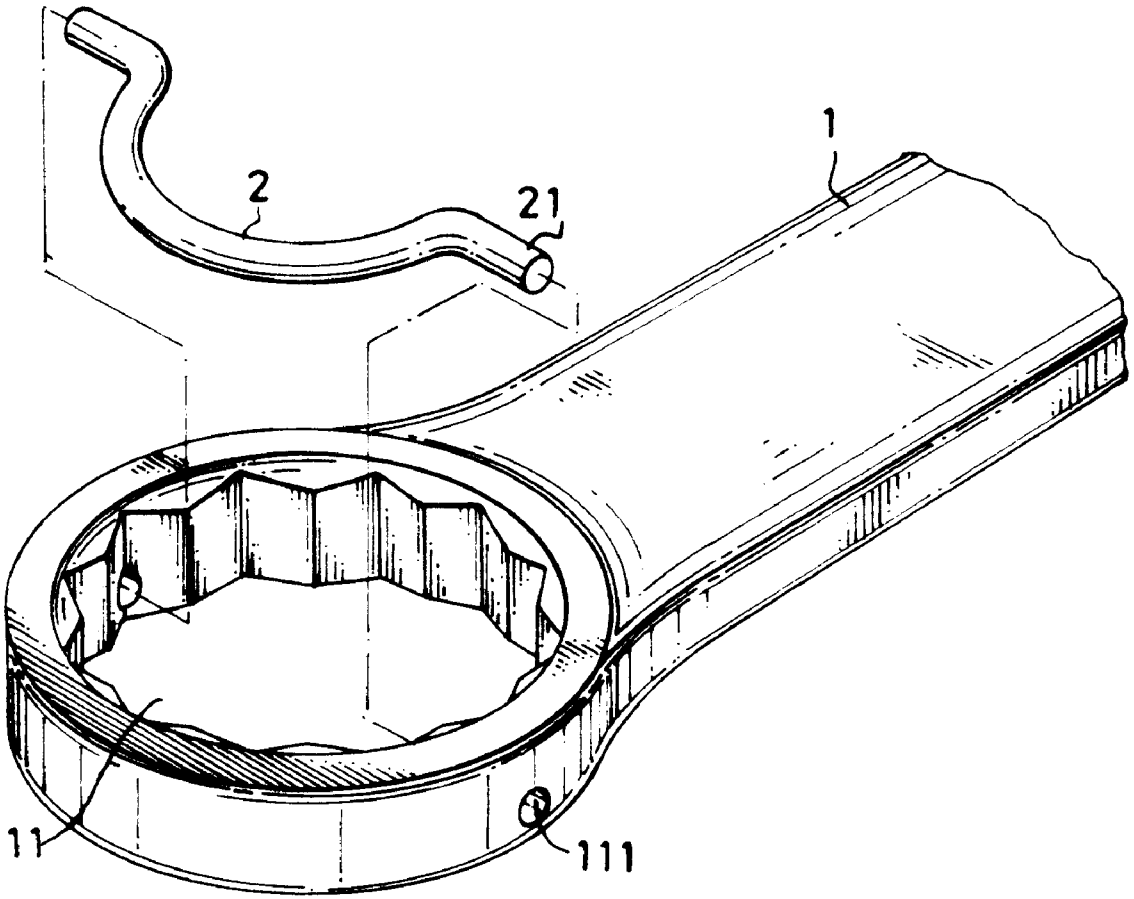
FIG. 10 is an exploded view of the box end wrench shown in FIG. 9.
Figure 11:
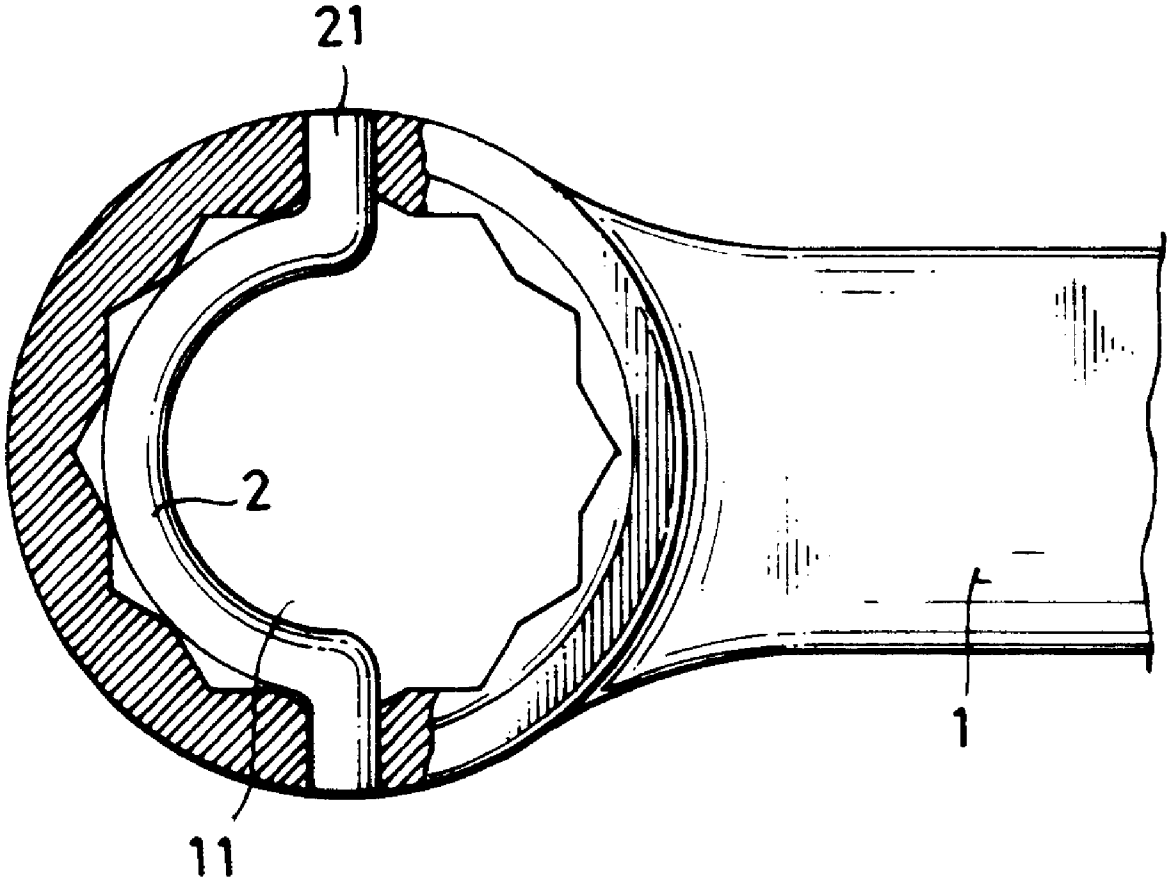
FIG. 11 is a top view in section of FIG. 9.
Figure 12:
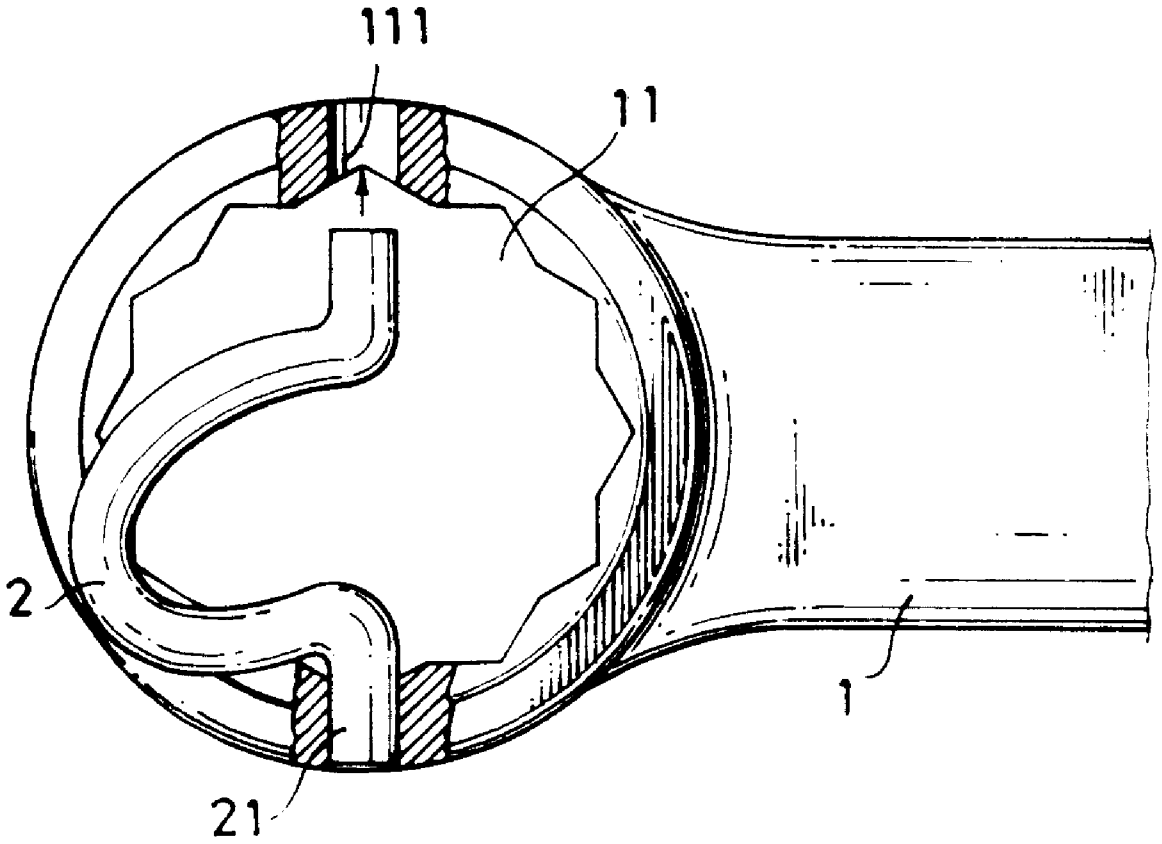
FIG. 12 is similar to FIG. 11 but showing the constraint spring rod deformed, one end of the constraint spring rod inserted into one radial through hole on the box end, the other end of the constraint spring rod aimed at the other radial through hole on the box end.

Referring to FIGS. from 9 to 12, a wrench is shown having a handle 1 and a box end 11 at one end of the handle 1. The box end 11 has two radial through holes 111 aligned at two opposite sides. A substantially Ω-shaped constraint spring rod 2 is mounted in the box end 11, having two opposite ends 21 respectively inserted into the radial through holes 111. When one end of the constraint spring rod 2 is inserted into one radial through hole 111 on the box end 11, the constraint spring rod 2 is squeezed and deformed (see FIG. 12), enabling the other end of the constraint spring rod 2 to be inserted into the other radial through hole 111 on the box end 11 (see FIG. 11). When installed, the arched middle section of the constraint spring rod 2 is closely attached to the inside wall of the box end 11 (see FIG. 11).

When the box end 11 of the wrench is sleeved onto for example a hexagon head bolt and attached to a nut, the arched middle section of the constraint spring rod 2 is stopped at the top of the nut, enabling the nut to be firmly retained in the box end 11 and positively turned with the wrench.

I claim:

1. A box end integral with one end of a handle for a box end wrench for grasping and turning bolts, nuts, wherein said box end comprises a box end body having two radial through holes aligned at two opposite sides, and a substantially Ω-shaped constraint spring rod mounted in said box end body for stopping above the workpiece to be turned, said constraint spring rod having two opposite ends respectively inserted into the radial through holes on said box end body from the inside of said box end body, and an arched middle section connected between the two opposite ends and closely attached to the periphery wall of said box end wrench on the side for stopping the workpiece in said box end boy.

* * * * *